US012324476B2

(12) United States Patent
Erwin

(10) Patent No.: US 12,324,476 B2
(45) Date of Patent: Jun. 10, 2025

(54) ARTICLE OF FOOTWEAR WITH HANDS FREE DONNING AND REMOVAL

(71) Applicant: David Erwin, Media, PA (US)

(72) Inventor: David Erwin, Media, PA (US)

( * ) Notice: Subject to any disclaimer, the term of this patent is extended or adjusted under 35 U.S.C. 154(b) by 349 days.

(21) Appl. No.: 17/125,883

(22) Filed: Dec. 17, 2020

(65) Prior Publication Data

US 2021/0186146 A1 Jun. 24, 2021

Related U.S. Application Data

(60) Provisional application No. 62/949,716, filed on Dec. 18, 2019.

(51) Int. Cl.

| | |
|---|---|
| ***A43B 11/00*** | (2006.01) |
| ***A43B 3/06*** | (2006.01) |
| ***A43B 3/34*** | (2022.01) |
| ***A43B 23/02*** | (2006.01) |

(52) U.S. Cl.

CPC ..... *A43B 11/00* (2013.01); *A43B 3/06* (2013.01); *A43B 3/34* (2022.01); *A43B 23/0245* (2013.01)

(58) Field of Classification Search

CPC ..... A43B 11/00; A43B 21/36; A43B 3/34; A43B 3/44; A43C 11/08

See application file for complete search history.

(56) References Cited

U.S. PATENT DOCUMENTS

| | | | | |
|---|---|---|---|---|
| 5,184,410 | A * | 2/1993 | Hamilton | A43B 11/00 36/105 |
| 5,282,327 | A * | 2/1994 | Ogle | A43B 11/00 36/105 |
| 5,557,866 | A * | 9/1996 | Prengler | A43B 5/00 36/138 |
| 5,813,144 | A * | 9/1998 | Prengler | A43B 13/203 36/71 |
| 8,499,474 | B2 | 8/2013 | Kaufman | |
| 9,149,711 | B1 * | 10/2015 | Kavarsky, Jr. | A63C 10/24 |
| 11,470,919 | B2 * | 10/2022 | Kilgore | A43B 23/0235 |
| 2002/0095823 | A1 * | 7/2002 | Laio | A43B 3/242 36/105 |
| 2003/0200680 | A1 * | 10/2003 | Chang | A43B 3/248 36/105 |
| 2005/0039348 | A1 * | 2/2005 | Raluy | A43C 11/00 36/105 |
| 2011/0277350 | A1 | 11/2011 | Huynh | |

(Continued)

*Primary Examiner* — Jillian K Pierorazio

(74) *Attorney, Agent, or Firm* — Howard IP Law Group, PC

(57) ABSTRACT

An article of footwear includes a door, positioned in a rear portion of an upper of the article of footwear. The door is movable between a first, closed position, and a second, open position. In the closed position, the door is releasably secured to an adjacent portion of the upper. In the open position, the door is releasably held in the open position, and a foot of the user may be inserted into or removed from the article. An actuator is in cooperative engagement with the door. The actuator is positioned in or on a rear portion of a heel and configured to be actuated only via striking a rear portion of the heel of the footwear on the back. Responsive to actuation of the actuator, the door moves between the closed position and the open position, thereby permitting hands-free donning and removal of the article of footwear.

20 Claims, 6 Drawing Sheets

(56) References Cited

U.S. PATENT DOCUMENTS

| | | | | |
|---|---|---|---|---|
| 2012/0079746 | A1* | 4/2012 | Ferreira | A43B 1/0081 36/105 |
| 2012/0317839 | A1 | 12/2012 | Pratt | |
| 2015/0216252 | A1* | 8/2015 | Wiens | A43B 1/0054 36/105 |
| 2015/0223554 | A1* | 8/2015 | Ardell | A43C 15/005 36/105 |
| 2017/0135428 | A1* | 5/2017 | Beckman | A43C 11/00 |
| 2018/0020764 | A1* | 1/2018 | Walker | G05B 15/02 700/275 |
| 2018/0110288 | A1* | 4/2018 | Hatfield | A43B 11/00 |
| 2018/0110289 | A1 | 4/2018 | Owings et al. | |
| 2018/0206588 | A1 | 7/2018 | Pratt et al. | |
| 2018/0213882 | A1* | 8/2018 | Morse | A43B 23/0295 |
| 2018/0235314 | A1* | 8/2018 | Farage | A43B 11/00 |
| 2018/0263332 | A1 | 9/2018 | Bruno | |
| 2018/0289109 | A1 | 10/2018 | Beers et al. | |
| 2018/0295942 | A1* | 10/2018 | Drake | A43C 11/004 |
| 2018/0303264 | A1 | 10/2018 | Katz et al. | |
| 2018/0338562 | A1* | 11/2018 | Hatfield | A43B 3/244 |
| 2018/0338566 | A1* | 11/2018 | Hatfield | A43B 23/0245 |
| 2018/0338583 | A1 | 11/2018 | Sullivan | |
| 2018/0368528 | A1 | 12/2018 | Beers et al. | |
| 2019/0111329 | A1* | 4/2019 | Kavarsky, Jr. | A63C 10/106 |
| 2019/0208855 | A1 | 7/2019 | Raia | |
| 2019/0246737 | A1 | 8/2019 | Weire | |
| 2020/0323308 | A1* | 10/2020 | Dubuisson | A43B 9/00 |
| 2021/0282495 | A1* | 9/2021 | Davis | A43C 11/12 |
| 2022/0031014 | A1* | 2/2022 | Seid | A43B 11/00 |

* cited by examiner

ARTICLE OF FOOTWEAR WITH HANDS FREE DONNING AND REMOVAL

CROSS-REFERENCE TO RELATED APPLICATION

This application claims priority to and benefit of U.S. Provisional Patent Application No. 62/949,716, filed Dec. 18, 2019, the entirety of which is incorporated herein by reference for all purposes.

FIELD OF INVENTION

The present disclosure is in the field of footwear, particularly shoes adapted for ease of donning and removal.

BACKGROUND

Many conventional shoes include laces, which require manual tying after the foot has been inserted into the shoe, and manual untying when the user is ready to remove the foot from the shoe. In order to tie the laces after donning the shoe, and in order to untie the laces before removing the shoe, the user must sit and bend to reach the laces. Even for shoes without laces, it is generally necessary for the user to sit and manipulate the shoe with the user's hands to don and remove the shoe.

The steps of sitting down and reaching one's hands to manipulate a shoe for donning and removal, and for tying and untying of laces, are time consuming for any user. Many health conditions cause such steps to be not only time consuming, but even difficult and painful. For example, arthritis affecting the hands and fingers makes tying and untying of laces difficult and even painful. Back injuries and conditions make the steps of sitting, standing, leaning and reaching difficult, impossible or painful.

Often, individuals may be carrying items, such as bags or briefcases, in their hands, and wish to don shoes when leaving a home, apartment or other dwelling, or to remove shoes on entering a dwelling. In order to do so, a person must place the item on the floor or other surface, sit and manipulate the shoes to don or remove the shoes, and then pick up the item again on standing. This requires additional effort and time to place the item on a surface and to lift the item again.

Techniques and apparatuses that render donning and removal of shoes more simple and less time consuming, preferably not requiring the wearer to sit, and preferably not requiring the use of the wearer's hands, are desirable.

SUMMARY

In an embodiment, an article of footwear includes a door, positioned in a rear portion of an upper of the article of footwear. The door is movable between a first, closed position, and a second, open position. In the closed position, the door is releasably secured to an adjacent portion of the upper. In the open position, the door is releasably held in the open position. An actuator is in cooperative engagement with the door. The actuator is positioned in or on a rear portion of a heel and configured to be actuated only via striking a rear portion of the heel of the shoe on the back. Responsive to actuation of the actuator, the door changes between the closed position and the open position, thereby permitting hands-free donning and removal of the shoe.

In an embodiment, an article of footwear includes a sole and an upper on the sole; the upper having an opening in a rear portion of the upper, and a door. The door movable between a first, closed position that closes the opening, and a second, open position, the opening permitting removal and insertion of a foot in the article of footwear when the door is in the open position. The article further includes an actuator in cooperative engagement with the door, positioned in a rear portion of a heel of the sole. The door is configured to, responsive to actuation of the actuator, move from the closed position to the open position, thereby permitting hands-free removal of the article of footwear.

In an embodiment, the article of footwear includes coupling elements providing cooperative engagement between the actuator and the door. The coupling elements may include one or more springs that are maintained in extension or compression, released by action of the actuator to move the door, and then brought back into extension or compression by further action of the actuator.

In an embodiment, a weight-sensitive element is responsive to insertion of the user's foot into the article of footwear, and is operatively coupled to the door to cause the door to move from the open position to the closed position. In this embodiment, activation of the actuator does not move the door from the open position to the closed position.

DETAILED DESCRIPTION

Conventional details of articles of footwear known to those of ordinary skill in the art are not shown. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein.

Figure 1:
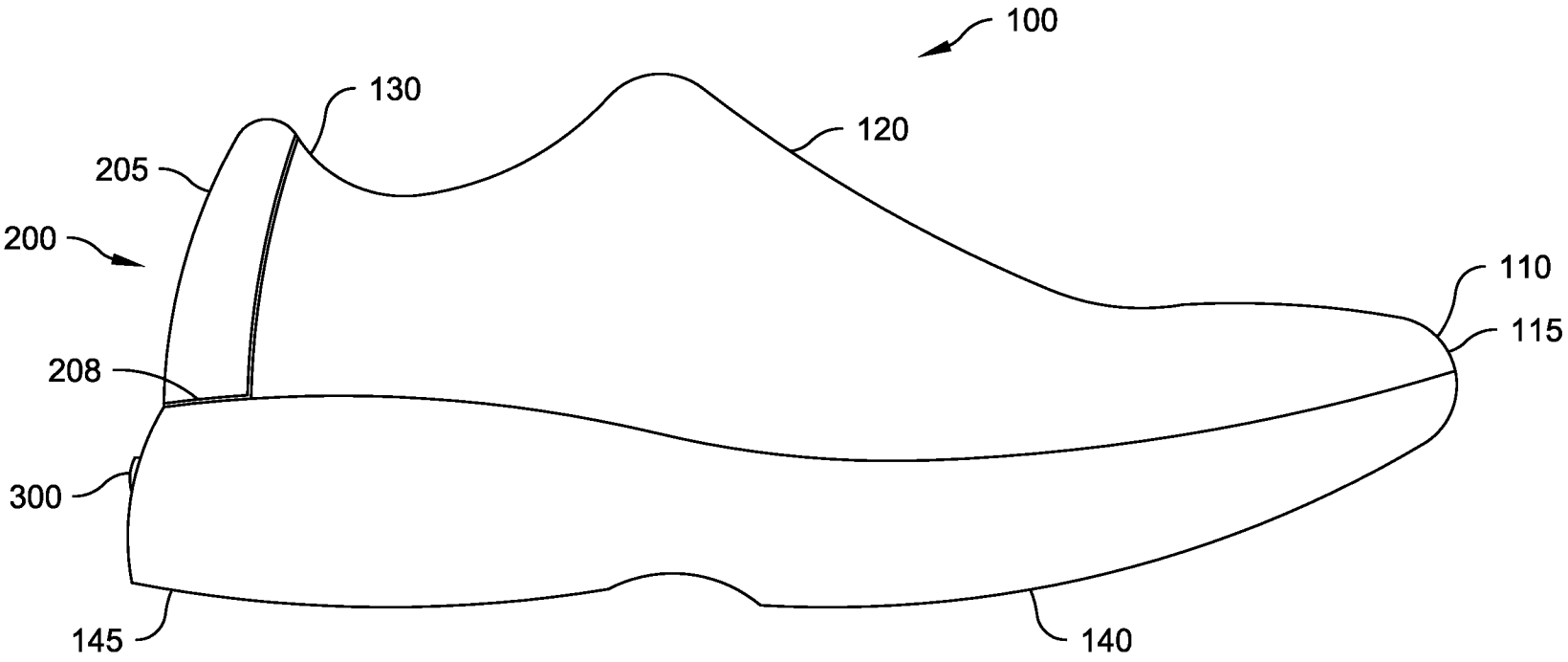
FIG. 1 is a partially schematic view of an article of footwear according to an embodiment.
Figure 2:
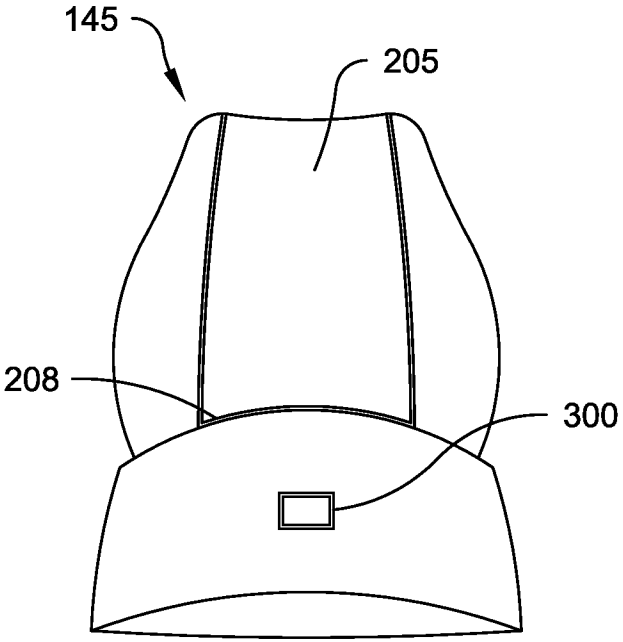
FIG. 2 is an end view of an article of footwear according to an embodiment.

Referring to FIG. 1, an embodiment is shown in partially schematic form. Shoe 100 is configured for hands free donning and removal. Shoe 100 includes sole 140 affixed to upper 110. Upper 110 includes toe portion 115, a central portion 120, including laces, and a rear portion 130 generally defining a wall surrounding a rear of the heel of the wearer. Sole 140 includes a heel portion 145, which is thicker in a vertical direction than other portions of sole 140.

Heel portion of sole 140 and the rear portion 130 of upper 110 include an apparatus 200 for opening and closing door 205 in rear portion 130 of upper 110 to facilitate hand-free donning and removal of shoe 100. Door 205 is generally defined by a portion of the rear portion of upper 110, forming a portion of the curved wall of the upper to the rear of the location of the wearer's heel. An actuator 300 is located within or on a back surface of the heel portion 145. Actuator 300 is coupled to door 205 so that, on operative engagement by the foot of the user with actuator 300, door 205, if closed, will open, permitting the user to remove or don the shoe without the use of hands, and, if door 205 is open, door 205 will close, rendering the shoe ready to be worn.

Actuator 300 is located in or on a rear surface of heel portion 145 so that only a motion to cause the heel portion of the shoe sole to contact a body, such as the floor or ground, at an angle or a portion of the surface not achieved in ordinary walking or running, will cause the door to open or close. The actuator may be interior to the heel or on a rear surface of the heel. Many types of shoes, such as running and other athletic shoes, have a substantial heel thickness to provide cushioning. Cavities may be defined within the substantial thickness of the heel to contain the actuator and cooperative elements, such as flexible sheets, line, and springs, with minimal effect on the cushioning performance of the thick heel. The uppers of many shoes include fabric layers that may also accommodate small springs and lines.

Figure 3A:
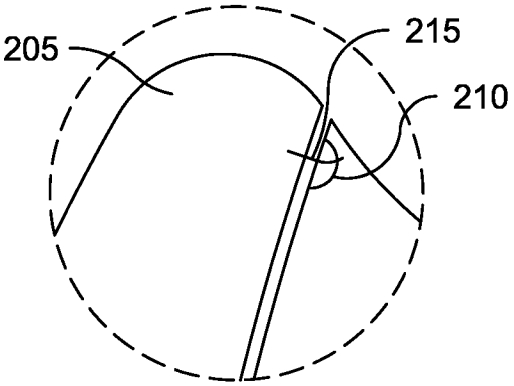
FIG. 3A is an expanded view of the portion of FIG. 3 marked as 3A.
Figure 3:
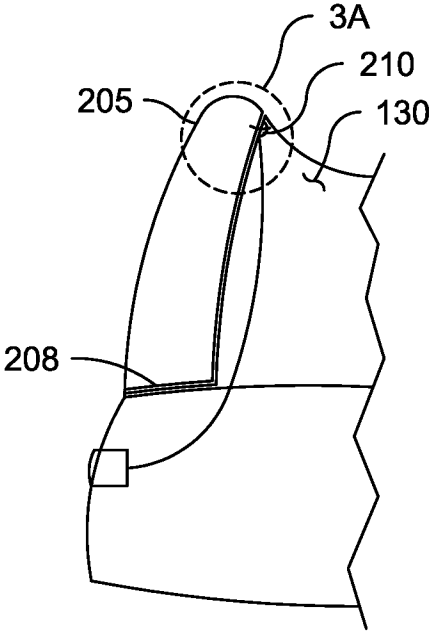
FIG. 3 is a partial side view of an article of footwear according to an embodiment.

Door 205 may have parallel straight sides, or the sides of door 205 may have a different profile. The width of door 205 is sufficient to permit passage of a foot of the wearer into and out of the shoe, and will vary dependent on size of the shoe and consequently the size of the foot. Door 205 is attached to the remainder of upper 110 by a hinge 208 at the bottom of door 205. Door 205 is movable between a closed position and an open position. In the closed position, which is shown in FIG. 3, for example, door 205 is in a generally vertical orientation, and the sides of door 205 are in line with the curvature of the rear portion 130 of the upper. In the open position, door 205 is at a sufficient angle from vertical to permit passage of the foot of the wearer into and out of the shoe. Door 205 may be in an open position at an angle between, for example, 100 degrees and 45 degrees from vertical.

Actuator 300 may be a spring-loaded mechanism, such as a spring-loaded clip, which, when pressed inward, causes an elongated coupling member to be pulled to cause door 205 to move from an open position to a closed position. In embodiments, a variety of coupling members and actions caused by those coupling members may provide this function. In an embodiment, a plurality of first elements may be provided on the door, and a plurality of second elements provided on the upper adjacent to the door, the first and second elements being configured to engage with one another to hold the door in the closed position. The first and second elements may be hooks and latches. For example, door 205 may be held in place in the closed position by one or more latches 210, which are rotatably or slidably mounted in the upper adjacent to the door 205, to engage with corresponding projections, such as hooks, in door 205. Actuator 300 is operatively coupled to latches 210. On engagement of actuator 300 by applying pressure to the rear of the heel of the shoe, when the door 205 is in the closed position, and the latches 210 are engaged with the hooks, latches 210 are caused to rotate or slide open, thereby disengaging the latches from the hooks, and permitting the door to move between the closed position and the open position.

The operative engagement between actuator 300 and latches 210 may be provided by one or more of multiple alternative structures. By way of example, a flexible elongated fiber or rope, or a sheet of flexible material, may provide operative engagement. The structure providing operative engagement is preferably contained within the heel of the sole or under a fabric surface of the upper, so as not to come into contact with the foot, sock or hose of the wearer.

The latches 210 may be maintained in place by sewing or gluing to the fabric of the upper. Latches 210 may be supported by elongated vertical bars or rods in the upper. The bars or rods serve to maintain the shape of the upper when the door is in the upper position.

In embodiments, the latches may be mounted on the door, and the hooks mounted on the upper. The hooks may then be mounted on the upper and operatively coupled to the actuator to be movable responsive to actuation of the actuator. In embodiments, other first and second elements configured to engage and disengage may be provided on the respective door and upper. Either or both of the first and second elements may be operatively coupled to the actuator to disengage responsive to actuation of the actuator.

Actuation or engagement of actuator 300 also causes an operative element to move door 205 between an open and closed position. For example, actuation of actuator 300 may release a spring coupled to door 205 to cause door 205 to rotate about its hinge from the closed position to the open position. In embodiments, the spring may be within a cavity in the heel of the sole, or may be a spring lying horizontally within the hinge, by way of example.

The term spring when used herein covers any element that serves to store potential energy when deflected under a load. Thus such items as helical compression springs, helical tension springs, torsion springs, flat spiral springs, and leaf springs are included within the term spring. In embodiments, hydraulic springs may be employed.

The embodiment of FIG. 1 shows door 205 having a hinge at its bottom 208. In other embodiments, the hinge may be at a different location, such as at a side of door 205. Hinge 208 may be defined by fabric, such as the fabric of the exterior of the shoe upper. The fabric may include one or reinforcing layers of fabric or other sheet material.

Figure 4:
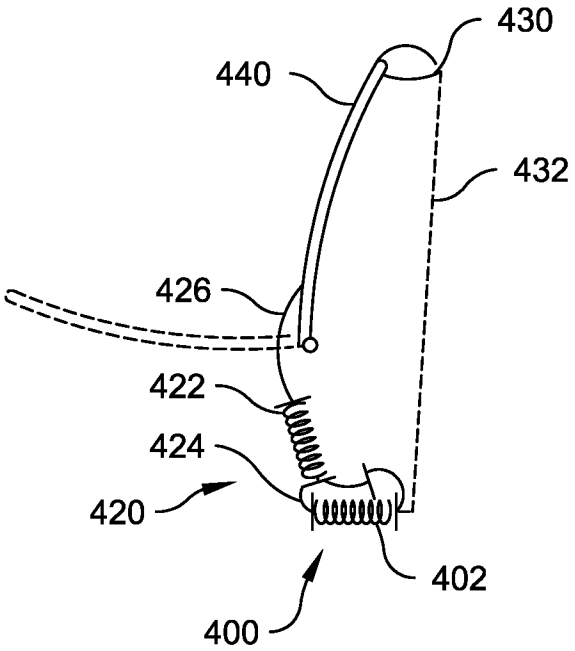
FIG. 4 is a schematic diagram showing an embodiment.

Actuator and operative coupling elements may take a wide variety of forms. A schematic diagram is shown in FIG. 4. Actuator, which is 400 in this illustration, is operatively coupled, via operative coupling elements 420, to door 440 to cause the door to move from its open position (dashed lines) to its closed position (solid lines), and to move from its closed position to its open position. In an embodiment, actuator 400 may include a spring loaded element which is moved in response to force applied to the actuator, so that the spring 402 is either in extension or compression. The operative coupling elements 420 are coupled to the actuator so that movement of the actuator releases a spring 422, held by a movable catch 424 in extension, which is connected to a wire, line or fabric 426, which is in turn connected to door 440 to pull door 440 from the closed position to the open position. As spring 402 continues to travel back to a neutral state, it pulls, again via suitable coupling, spring 422 back into extension, and causes catch 424 to engage spring 422. Spring 422 is thus effectively cocked for the next actuation. Actuator 400 also moves coupling element 432, which may be a line, wire or fabric, to move latches 430 to release door 440.

When the door 440 is in the open position (shown in dashed lines), a second spring operatively coupled to actuator 400 and door 440 may be held in compression or extension, and released, similarly to spring 422 and catch 424, to move door 440 into the closed position. Catches 430 may be configured to rotate to permit corresponding hooks 432 to slide and then engage. In another embodiment, spring 422 may be configured with operative coupling to two lines, wires or sheets so as to move door 440 into the closed position on alternating activations of actuator 400.

Figure 5:
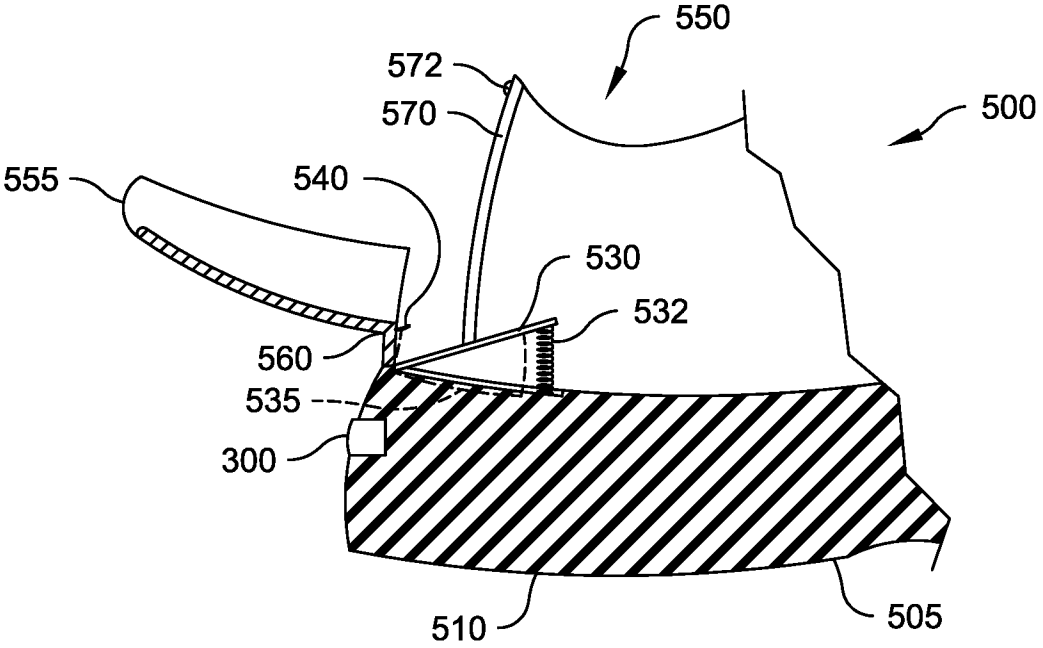
FIG. 5 is a schematic diagram showing an embodiment in which a weight-sensitive element located to be pushed by the user's heel actuates closing of the door.

Referring to FIG. 5, an embodiment is illustrated in which a weight-sensitive element located to be pushed by the user's heel actuates closing of the door. Shoe 500 is shown in partial cross-section, with the heel portion 510 of sole 505 shown in cross-section, with cross-hatching to designate the cross-section. Upper 550 is shown on heel portion 510, with door 555, which is a curving surface, shown in cross-section in an open position, pivoted around hinge 560. In upper 550, the inner wall 570 that is adjacent to the door 555 when the door is in the closed position is shown with a movable latch 572 that engages the door.

A weight-sensitive element located to be pushed by the user's heel, in the form of spring-loaded lever 530, is shown. Spring-loaded lever 530 is shown mounted at a hinge connection at the back of the heel, and supported by spring 532 under the heel. Spring-loaded lever 530 is operatively coupled to an element that pulls door 555 into the closed position. For example, spring-loaded lever 530 may be connected to a line 535 which moves a catch (not shown) to release schematically shown spring 540, which may be held in extension by the catch. Spring 540 may be located in the rear wall of the upper, or in the heel, and operatively coupled to door 555 to cause door 555 to rotate into the closed position. Lever 530 may also be operatively coupled to movable latch 572 so as to move latch 572 into position to engage with an element on door 555 to maintain door 555 in the closed position. For example, lever 530 may be coupled to a line which is coupled to latch 572.

Spring-loaded lever 530 may also be coupled to one or more other springs or the like to provide a mechanism to return spring 540 to its extension position, and to move the catch back into position to hold spring 540.

In the embodiment of FIG. 5, the actuator 300 is present to provide for opening of the door. For simplicity of illustration, the operative elements for opening the door responsive to force on actuator 300 are not shown. Thus, in the embodiment of FIG. 5, the user opens the door for shoe removal by applying force to actuator 300 at the rear of the heel. The shoe closes automatically when the user applies weight on the weight-sensitive element in the heel. Thus, in the embodiment of FIG. 5, the user does not activate the actuator 300 to close the door as the final step in donning of the shoe.

In embodiments, suitable gearing may be provided to translate linear motion of a portion of the actuator into rotational or other motion of coupling elements. In embodiments, a piece of fabric, wire or the like may be arranged using a gearing or pulley structure to provide for pulling the door between positions without the use of a spring.

Suitable fabric material must maintain its dimensions under stress. Nylon or polyester woven fabrics of suitable weight may be employed.

Operative elements may be contained in housings having rigid or flexible walls to prevent interference between operative elements, such as springs, wires, lines and gears, and the fabric and cushion material of the upper and sole.

In embodiments, the actuator may be on an exterior surface of the back of the heel of the shoe. Operative coupling may be achieved via mechanical structures extending into the heel of the shoe and/or into the upper.

The actuator should be configured so that it is not received into the cushioning material of the heel rather than being activated by an applied force on the back. A reinforcing band or other structure, anchored, such as by adhesive, at multiple attachment points on the heel, and/or anchored by stitching or adhesive to the upper, may be provided to prevent excessive movement of the actuator in the material of the heel.

Other actuator embodiments may be provided, such as a wheel that extends outside the rear of the heel and is rotatable responsive to a sliding motion of the heel on a surface, such as the ground or floor. The wheel is then operatively engaged with the door, such as by spring structures as described above, to move the door between open and closed positions responsive to rotation of the wheel. Alternatively a sliding actuator may be provided, which is similarly responsive to a sliding motion of the heel. In an embodiment, the actuator may take the form of a switch having two positions; responsive to pressure on the heel, the switch moves from one of its two positions to the other, and is operatively coupled to the door so as to cause the door to move from one position to another responsive to movement of the switch between its two positions.

In an embodiment in which a rotating wheel serves as the actuator, the wheel may be movable to rotate only in one direction. A progressive rotation when the door is closed causes the door to be released and the door to move to the open position. A progressive rotation in the same direction when the door is open causes the door to move from the open position to the closed position, and causes any movable closing elements to engage the door. This technology may be employed in alternate actuator types. For example, a wheel may be provided that is advanced in the same direction by movement of an actuator or a lever or other element. Such a wheel is not directly engaged by the user's action, but indirectly via the actuator or weight-sensitive element.

In embodiments, rather than the clip/hook arrangement to maintain the door in the open position, other reversible fastening technologies may be employed. By way of example, cooperating magnets, or magnets cooperating with metallic elements, may be employed in the door and the corresponding portion of the upper. On movement of the door into the closed position, the respective magnets hold the door in the closed position. The magnets in the corresponding portion of the upper may be mounted within elongated cavities, and may be on tracks, so as to be moved away from the corresponding magnets in the door responsive to activation of the actuator.

In embodiments, corresponding hook and loop tape (such as Velcro® brand hook and loop tape) may be provided on the door and the corresponding edges of the opening in the heel of the upper to maintain the door in the closed position during wearing. In these embodiments, the force exerted by the spring must be sufficient to detach the respective hook tape from the loop tape.

In an embodiment, the actuator may be contained in a module having a housing contained within a cavity in the heel and having a rear outer cover that is either flush with the back of the heel or protrudes slightly. Responsive to pressure on the outer cover, the rear wall may compress elastically to transmit force to the actuator, or the housing may be elastically mounted to slide into the sole.

The actuator is mechanical in embodiments. In an alternative embodiment, a mechanical or electrical switch may be provided in the rear of the heel to actuate small motors or small electromagnets, using a battery power source, which may be positioned in the heel, to move the door and latches via mechanical coupling, or to release springs to move the door and latches.

Figure 6:
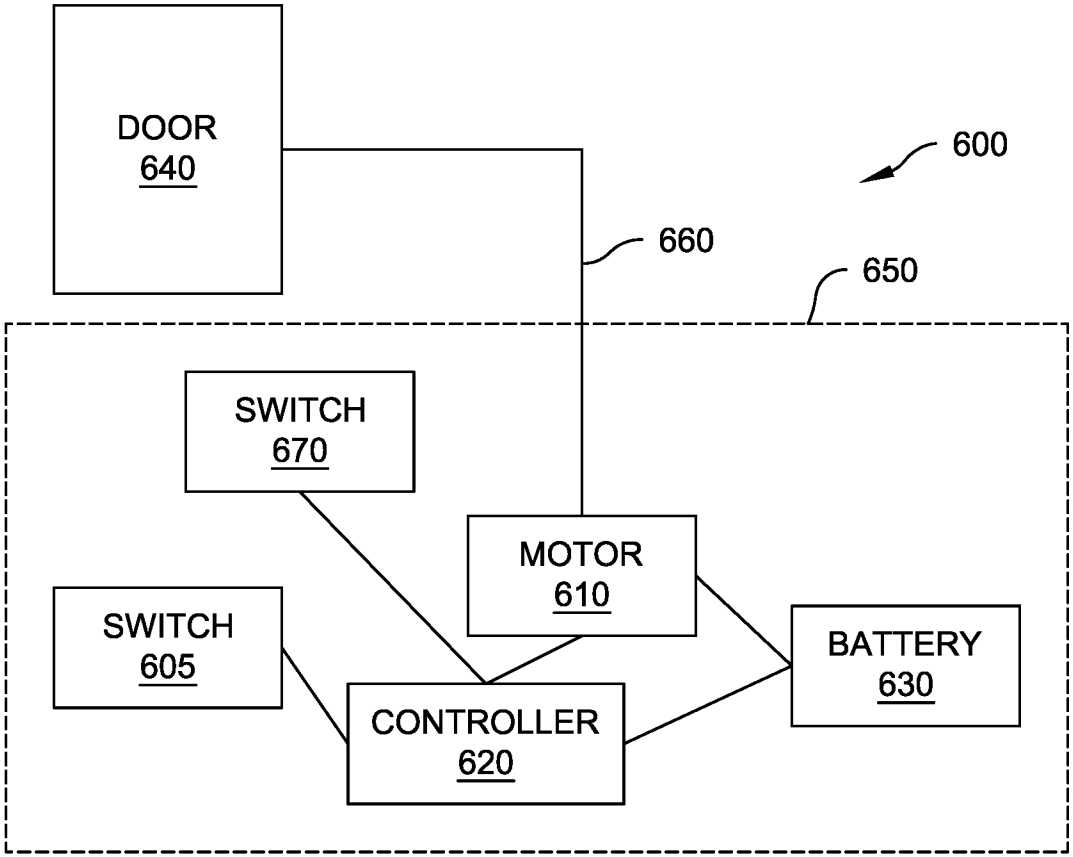
FIG. 6 is a schematic diagram showing an embodiment in which a motor is provided for opening and closing the door.

Referring to FIG. 6, a schematic diagram of an embodiment employing a motor powered by a battery power source in the shoe is shown. Heel 650 of the article of footwear, shown in dashed lines, contains switch 605, motor 610, controller 620 and battery 630. In embodiments, one or both of battery 630 and controller 620 may be located elsewhere in the article of footwear, such as in an instep. Switch 605, which serves as the actuator, is electrically coupled to controller 620, which receives a signal when switch 605, which may be an electro-mechanical switch, is actuated. Controller 620 may be an integrated circuit controller have a processor, memory storing program data to instruct the processor, memory storing other data, and input and output connections, which may include analog to digital and/or digital to analog converters. Controller 620 is electrically coupled to motor 610. Battery 630 is electrically coupled to motor 610 and controller 620 to provide power. Controller 620 is programmed to provide a control signal to motor 610. responsive to a signal from switch 605. Controller 620 may also maintain in memory data indicative of a current status of door 640, either open or closed, depending on the most recent control signal provided to motor 610. Alternatively, a circuit may be provided coupled to controller 620 that provides data indicative of closed or open status of the door; for example, the circuit may be closed by contacts on door and the upper which are only in contact when the door is closed. The control signal provided by controller 620 to motor 610 causes motor 610 to drive mechanical coupling, shown schematically at 660, to move the door between the open and closed position. Mechanical couplings may include springs to maintain the door in one position absent the application of force, a cable or thread on a spool which is rotated via an actuator to move the door and/or engagement elements on the door or the upper, linear actuators to extend or retract cables, and other mechanical couplings.

Referring to FIG. 6, in embodiments, a second switch, such as a pressure-activated switch 670, may be provided, for causing the controller to provide a control signal to the motor to cause the door 640 to close. Further, in other embodiments, more than one motor may be provided, such as to effect separate operations, such as opening and closing the door.

The article of footwear may be a shoe, such as a running shoe or other athletic shoe, such as a running shoe with laces, a loafer, a lace-up formal shoe, a boot, molded athletic footwear or other type of footwear that encloses the user's foot. In an embodiment in which the article of footwear is a boot, the door may extend upward from the rear of the heel of the boot through the shaft to the top edge of the boot. The article of footwear may be made of a waterproof foam or resin, such as waterproof footwear of foam or resin having through holes suitable for beach or pool wear.

Shoes with laces need not be untied and retied between wearings, thereby saving time, and permitting the user to lace the shoe a single time to an optimal comfort level that may be used without untying, loosening and then retightening, adjusting and re-tying. Embodiments are applicable, as noted above, to molded shoes that do not include laces.

As the user may remain standing, the need to bend, reach and manipulate the shoe and laces is removed. Users will save time and effort in removing and donning shoes. Users having difficulty or experiencing pain, such as due to back or leg injuries or conditions, in bending, standing and sitting, will find the process of donning and removal of shoes to be easier, and in some cases free of pain. Users will not need to place objects in their hands down and then pick those objects up again after removing or donning shoes, thereby achieving greater convenience.

The embodiments described herein are exemplary, and other variations are feasible within the scope of the disclosure.

What is claimed is:

1. An article of footwear, comprising:

a sole and an upper on the sole;

the upper comprising a rear portion including a door movable between a first, closed position, and a second, open position, the door being releasably secured to an adjacent portion of the upper in the closed position, and the door permitting removal and insertion of a foot in the article of footwear in the open position;

the sole having an actuator, in cooperative engagement with the door, positioned in a rear portion of a heel of the sole and configured to be actuated only via force applied to a rear exterior surface of a heel of the article of footwear;

the door configured to, responsive to actuation of the actuator, move from the closed position to the open position, thereby permitting hands-free removal of the article of footwear, and responsive to motion of a user foot, move from the open position to the closed position, thereby permitting hands-free donning of the article of footwear.

2. The article of footwear of claim 1, wherein the actuator is configured to cause the door to move from the open position to the closed position.

3. The article of footwear of claim 1, further comprising a weight-sensitive element located to be pushed by the user's heel to cause the door to move from the open position to the closed position.

4. The article of footwear of claim 1, further comprising a plurality of first elements on the door, and a plurality of second elements on the upper adjacent to the door, the first and second elements being configured to engage with one another to hold the door in the closed position.

5. The article of footwear of claim 4, wherein the first elements comprise hooks, and the second elements comprise latches.

6. The article of footwear of claim 1, further comprising a spring operatively coupled to the actuator and to the door, wherein, responsive to engagement of the actuator, the spring causes the door to move from the closed position to the open position.

7. The article of footwear of claim 1, wherein the article of footwear is a running shoe having laces.

8. The article of footwear of claim 1, comprising a motor coupled to the door via mechanical coupling, the motor configured to open and close the door.

9. An article of footwear, comprising:

a sole and an upper on the sole;

the upper having an opening in a rear portion of the upper, and a door, the door movable between a first, closed position that closes the opening, and a second, open position, the opening permitting removal and insertion of a foot in the article of footwear when the door is in the open position;

an actuator in cooperative engagement with the door, the actuator configured for actuation responsive only to force applied to a rear exterior surface of a heel of the sole;

the door configured to, responsive to actuation of the actuator, move from the closed position to the open position, thereby permitting hands-free removal of the article of footwear.

10. The article of footwear of claim 9, wherein the actuator is configured to be actuated only via force applied to a portion of the rear exterior surface of the heel not contacted in ordinary walking or running.

11. The article of footwear of claim 9, wherein the door is configured to, responsive to motion of a user foot, move from the open position to the closed position, thereby permitting hands-free donning of the article of footwear.

12. The article of footwear of claim 11, further comprising a weight-sensitive element located to be pushed by the user's heel to cause the door to move from the open position to the closed position.

13. The article of footwear of claim 9, further comprising a plurality of first elements on the door, and a plurality of second elements on the upper adjacent to the door, the first and second elements being configured to engage with one another to hold the door in the closed position.

14. The article of footwear of claim 13, wherein the first elements comprise hooks, and the second elements comprise latches.

15. The article of footwear of claim 9, further comprising a spring operatively coupled to the actuator and to the door, wherein, responsive to engagement of the actuator, the spring causes the door to move from the closed position to the open position.

16. The article of footwear of claim 9, wherein the article of footwear is a running shoe having laces.

17. The article of footwear of claim 9, comprising a motor coupled to the door via mechanical coupling, the motor configured to open and close the door.

18. The article of footwear of claim 1, wherein the actuator is configured to be actuated only via force applied to a portion of the rear exterior surface of the heel not contacted in ordinary walking or running.

19. An article of footwear, comprising:

a sole and an upper on the sole;

the upper comprising a rear portion including a door movable between a first, closed position, and a second, open position, the door being releasably secured to an adjacent portion of the upper in the closed position, and the door permitting removal and insertion of a foot in the article of footwear in the open position;

the sole having an actuator, in cooperative engagement with the door, positioned in a rear portion of a heel of the sole and configured to be actuated only via force applied to a rear surface of the heel of the article of footwear;

the door configured to, responsive to actuation of the actuator, move from the closed position to the open position, thereby permitting hands-free removal of the article of footwear, and responsive to motion of a user foot, move from the open position to the closed position, thereby permitting hands-free donning of the article of footwear;

a plurality of first elements on the door, and a plurality of second elements on the upper adjacent to the door, the first and second elements being configured to engage with one another to hold the door in the closed position;

wherein the second elements are moveably mounted on the upper, and are operatively connected with the actuator to move from engagement with the first elements to disengagement from the first elements responsive to actuation of the actuator.

20. An article of footwear, comprising:

a sole and an upper on the sole;

the upper having an opening in a rear portion of the upper, and a door, the door movable between a first, closed position that closes the opening, and a second, open position, the opening permitting removal and insertion of a foot in the article of footwear when the door is in the open position;

an actuator in cooperative engagement with the door, the actuator configured for actuation responsive only to force applied to a rear surface of a heel of the sole;

the door configured to, responsive to actuation of the actuator, move from the closed position to the open position, thereby permitting hands-free removal of the article of footwear; and a plurality of first elements on the door, and a plurality of second elements on the upper adjacent to the door, the first and second elements being configured to engage with one another to hold the door in the closed position;

wherein the second elements are moveably mounted on the upper, and are operatively connected with the actuator to move from engagement with the first elements to disengagement from the first elements responsive to actuation of the actuator.

* * * * *